United States Patent [19]

McMaster

[11] 4,117,252

[45] Sep. 26, 1978

[54] HIGH TEMPERATURE FURNACE

[76] Inventor: Harold A. McMaster, 420 Water St., Woodville, Ohio 43469

[21] Appl. No.: 746,455

[22] Filed: Dec. 1, 1976

[51] Int. Cl.[2] ..... H05B 3/06

[52] U.S. Cl. ..... 13/25; 338/289; 219/552

[58] Field of Search ..... 13/20, 25, 22; 338/288, 338/289, 290, 283, 279, 291; 219/552, 553, 532

[56] References Cited

U.S. PATENT DOCUMENTS

| | | | |
|---|---|---|---|
| 1,533,255 | 4/1925 | Little | 13/25 |
| 1,827,508 | 10/1931 | Cope | 338/289 |
| 4,011,395 | 3/1977 | Beck | 13/25 |

*Primary Examiner*—R. N. Envall, Jr.

*Attorney, Agent, or Firm*—Reising, Ethington, Barnard, Perry & Brooks

[57] ABSTRACT

A high temperature furnace particularly adapted for fusing crystalline silica includes a housing defining a heating chamber that receives electrically conductive elements with insulators positioned therebetween to establish an electrical flow path for heating the chamber. Resilient gas cylinders located externally of the housing bias graphite connecting rods that extend into the heating chamber to compress and position the conductive elements and the insulators therebetween while allowing expansion thereof during heating of the chamber. Graphite wall panels preferably define the housing heating chamber and have interlocking edges that position the panels relative to each other. Cooperable pairs of resilient gas cylinders at longitudinal ends of the furnace housing compress the wall panels to maintain the edges thereof in their interlocking relationship while permitting expansion during heating of the chamber. Preferably, the furnace is of the counterflow type with upper and lower conveying passages through the heating chamber and upper and lower heating portions that receive the conductive elements and the insulators. Graphite spacer blocks and heater bars provide the conductive elements while boron nitride discs provide the insulators that cooperate with the heating elements to provide a serpentine electrical flow path for heating the chamber. A conveyor automatically conveys graphite trays through the conveying passages in opposite directions. Pushers of the conveyor move the trays along the direction of conveyance while transfer mechanisms at the ends of the furnace automatically move the trays from one conveying passage to the other. Each transfer mechanism includes an indexer for moving the trays into and out of the housing and a table that moves the trays vertically. During indexing back into the housing from the table, scraper bars of the transfer mechanism engage leading and trailing edges of the trays to remove a parting agent that is applied to the trays to prevent the crystalline silica from reacting with the graphite tray material. Electrical terminals extend between an outer skin of the furnace and the heating chamber through carbon black powder insulation and have a construction that accommodates for longitudinal expansion of the heating chamber while maintaining a sealed relationship and limiting outward heat flow.

36 Claims, 11 Drawing Figures

HIGH TEMPERATURE FURNACE

BACKGROUND OF THE INVENTION

1. Field of the Invention

This invention relates to a high temperature furnace that is capable of heating products to temperatures on the order of 3000° F. and higher such as is necessary in fusing silica.

2. Description of the Prior Art

Certain materials must be heated to a relatively high temperature before fusing or melting occurs. For example, crystalline silica must be heated to a temperature between 3100° and 3200° F. before fusing of the silica takes place to form an amorphous material. Since very few materials remain solid without decomposition at these elevated temperatures, it is difficult to construct furnaces capable of heating materials to these high temperatures.

One type of prior art furnace utilized to heat materials to the temperature range involved includes an elongated carbon housing of a tubular shape with electrical terminals at each of its ends. At a mid-point intermediate the electrical terminals, the tubular wall thickness of the housing necks down so as to provide a location of greater resistance where relatively high temperatures are generated. There is a limit to the voltage that can be applied to this type of furnace, i.e., on the order of 4 or 5 volts, and thus relatively high currents on the order of 2000 amps or more must be used to develop the heat input required.

Another type of prior art furnace for generating high temperatures utilizes electrically conductive graphite elements which are threaded to provide nut and bolt connections that establish an electric flow path through the chamber of the furnace to be heated. U.S. Pat. Nos. 2,472,612 and 3,004,090 disclose furnaces of this type.

Also, U.S. Pat. No. 3,567,196 discloses a conveyor for transporting products to be heated through a high temperature furnace.

SUMMARY OF THE INVENTION

An object of the present invention is to provide an improved high temperature furnace. Although the furnace can be used in various high temperature heating applications, it is particularly adapted for use in fusing crystalline silica.

In carrying out the above object and other objects of the invention, the high temperature furnace includes a housing defining a heating chamber that receives a plurality of electrically conductive elements with electrical insulators positioned between the elements to establish an electrical flow path therethrough for heating the chamber. The conductive elements and insulators are resiliently compressed by a source located externally of the housing so as to be maintained in position with respect to each other while still being allowed to expand during heating of the chamber. Preferably, at least one extendable and retractable resilient gas cylinder mounted externally of the housing biases an associated connecting rod that extends into the heating chamber to compress the conductive elements and the insulators. Graphite is preferably used to form wall panels that define the chamber and to form the conductive elements as well as the connecting rod that compresses and positions the conductive elements and the insulators, while the insulators are preferably formed from boron nitride.

Interlocking edges of the graphite wall panels defining the heating chamber are maintained in position by one or more additional extendable and retractable resilient gas cylinders such that the wall panels are allowed to expand during heating while still being maintained in position relative to each other. Cooperable pairs of these gas cylinders are preferably located at longitudinal ends of the furnace housing and compress the wall panels toward the longitudinal center of the housing. Separating wall panels of the housing divide the heating chamber into at least one conveying passage for receiving products to be heated and at least one heating portion that receives the conductive elements and the insulators. As disclosed, two vertically spaced upper and lower conveying passages are defined in the heating chamber between upper and lower heating portions that receive associated conductive elements and insulators so that the products are heated from both above and below. Interlocking connections between the separating wall panels and side wall panels as well as interlocking connections between top wall panels and the side wall panels prevent outward side wall movement. Also, replaceable graphite side wall liners prevent reaction of the graphite side wall panels with products being heated.

The electrically conductive graphite elements include spacer blocks positioned at lateral sides of the associated heating portion of the chamber and elongated heater bars extending laterally between the spacer blocks. Certain of the spacer blocks and the adjacent ends of the heater bars have the boron nitride insulators positioned therebetween so as to establish a serpentine electrical flow path for heating the chamber. Best utilization of the relatively expensive boron nitride material is made by forming the insulators in the shape of round discs. Plug holes within the disc-shaped boron nitride insulators and within the conductive spacer blocks and heater bars receive boron nitride plugs that locate the insulators relative to the conductive elements. Also, the boron nitride insulators are used to space the conductive elements from lateral side walls of the heating chamber and from the lower horizontal wall of the associated heating portion of the chamber.

A conveyor automatically conveys products to be heated through the heating chamber of the furnace. When two conveying passages are provided, as in the preferred embodiment disclosed, the direction of conveyance is preferably in opposite directions so that the furnace heats in a "counterflow" fashion. In this connection, a horizontal separating wall between the two vertically spaced conveying passages has openings adjacent longitudinal ends of the furnace to aid in heat transfer between heated products ready to be conveyed out of one of the passages and cold products just entering the other passage.

Conveyance of the products being heated is accomplished by the furnace conveyor through the use of graphite trays that are pushed through the conveying passages. A pusher located at each end of the furnace pushes the trays in opposite directions in the two passages. When used to fuse silica which is an application for which the furnace is particularly adapted, a first feeder initially covers the trays with powdered carbon black that acts as a parting agent, and a second feeder subsequently deposits crystalline silica to be fused over the parting agent. Formation of silicon carbide by the carbon black parting agent and the crystalline silica prevents the graphite trays from reacting in this manner and consequent tray deterioration. Leading and trailing edges of the trays overlap each other to prevent the parting agent from falling between the trays within the conveying passages during the heating.

At the longitudinal ends of the furnace housing, the conveyor includes transfer mechanisms for automatically transferring the trays from one conveying passage to the other. Each transfer mechanism includes an indexer for indexing the trays laterally into and out of the conveying passages and a table that moves the trays vertically between the passages. A pair of scraper bars have elongated guide portions and scraper portions that engage the leading and trailing edges of the trays during indexing to clean these edges of any carbon black parting agent that may have fallen between the trays. One of the scraper bars is preferably movably mounted and biased by a cylinder toward the other one so as to provide the scraping action that cleans the tray edges. Cleaning action provided by the scraping is best performed during the indexing of the trays back into the conveying passages from the vertically movable table. Opposite edges of the table engage the scraper bars to prevent the cylinder bias from causing the scraper portions of the bars from cutting material off the tray edges.

Porous carbon wall panels are utilized in the elongated furnace housing construction to limit heat flow from the heated central portion of the heating chamber longitudinally toward its cooler ends. Insulation in the form of powdered carbon black about the wall panels defining the heating chamber limits heat flow to the environment and is received within an outer sheet metal skin. Electrical terminals extend from the housing skin to the heating chamber to transmit electricity to the conductive elements. Each electrical flow path includes a pair of terminals and a common grounding bar connected to the conductive elements centrally between the terminals, and an AC voltage is applied across the terminals to heat the chamber. The largest potential between ground and any conductive element connected to the two terminals is only half what it would be without the centrally located grounding bar. A greater number of electrical elements can be connected with the externally compressed element feature of this furnace than with the prior art furnaces so as to provide a flow path with a greater electrical resistance. Consequently, a greater voltage can be utilized and applied over a lesser number of terminals to provide any given heat input into the furnace. Since the terminals are the locations must likely to transfer heat to the environment and thereby lessen the heated temperature of the chamber, minimization of the total number of terminals utilized is desirable. Likewise, maintaining the electrical potential as close to ground as possible by use of the grounding bar lessens the likelihood of arcing between the conductive elements and the grounded wall panels.

Each electrical terminal of the furnace has a construction including a passage tube extending between its outer skin and the heating chamber. Porous carbon is preferably utilized to form the passage tube which includes an opening therethrough having a larger size adjacent the heating chamber than adjacent the outer skin. A terminal bar made of graphite extends through the passage tube opening and has an inner end connected to the conductive elements and an outer end mounted on the housing skin. A water cooled mount secured to the skin locates a centering ring that engages the passage tube about the outer end of its opening. Fused silica spacers are received within recesses in the centering ring and engaged with the outer end of the terminal bar. A metallic mounting ring preferably made of aluminum also has recesses that receive the spacers and is spring biased inwardly so that the spacers mount the terminal bar in a spaced relationship with respect to the passage tube inside its opening as well as compressing the centering ring against the passage tube and the tube against the heating chamber. A water cooled terminal block secured to the extreme outer end of the terminal bar applies a voltage which is carried by the terminal bar to the conductive elements within the heating chamber. An atmospheric seal extends between the centering ring mount and the terminal block to enclose the fused silica spacers and the mounting ring in a manner that seals the terminal from the environment.

During heating of the furnace, expansion of the conductive elements and the heating chamber panel walls longitudinally is allowed by the resilient gas cylinders while the terminal passage tubes and associated terminal bars pivot to allow such expansion. The larger size of the passage tube openings adjacent the heating chamber than adjacent their outer ends functions to minimize any chance that the inner ends of the terminal bars will ground with the passage tubes.

The objects, features and advantages provided by the present invention are readily apparent from the following detailed description of the preferred embodiment taken in connection with the accompanying drawings.

DETAILED DESCRIPTION OF THE PREFERRED EMBODIMENT

Figure 1:
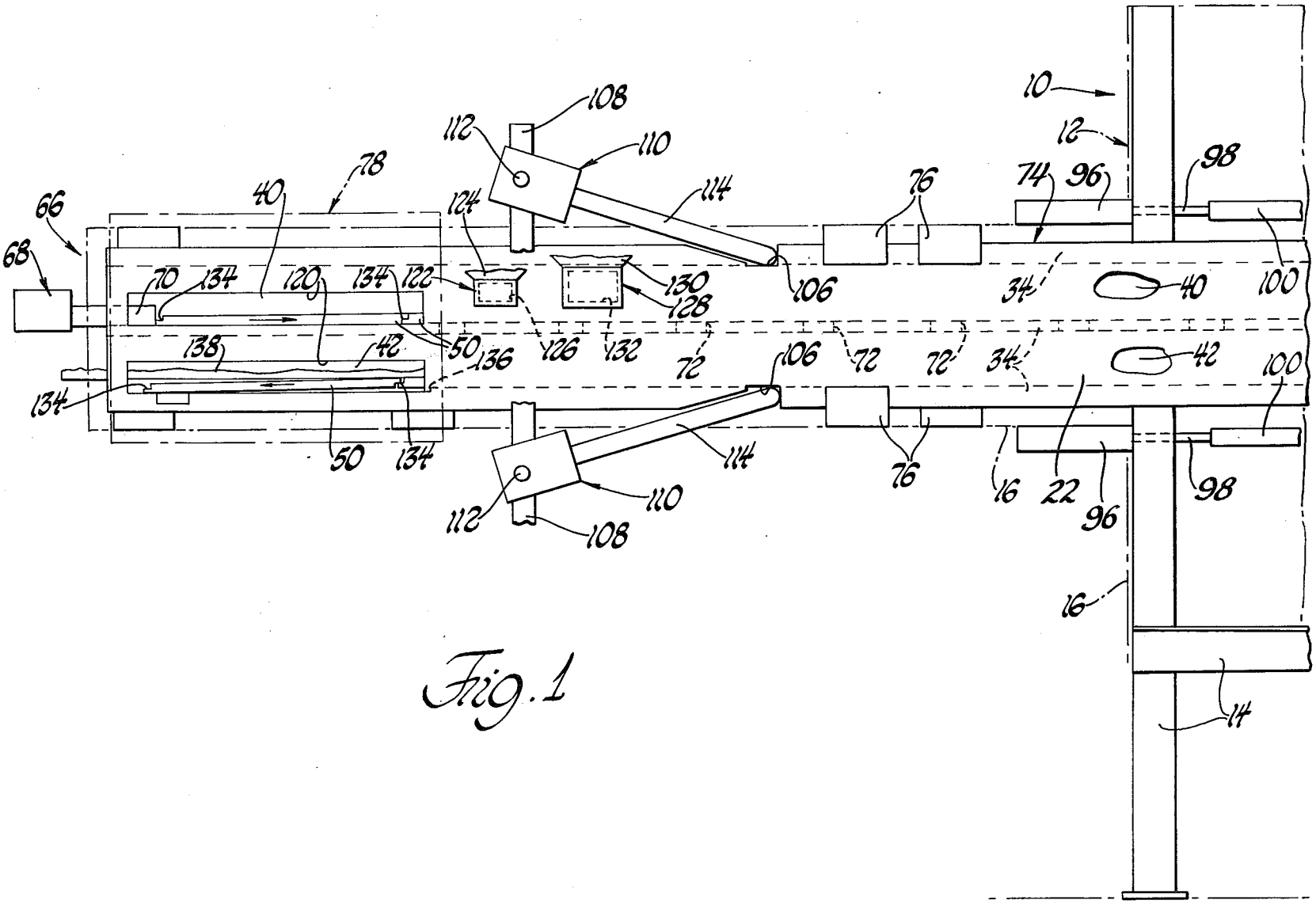
FIGS. 1, 1A and 1B aligned from the left to the right in that order cooperate to provide a side elevation view of a furnace embodying the present invention with certain components of the furnace shown in phantom and in schematic for clarity.
Figure 1A:
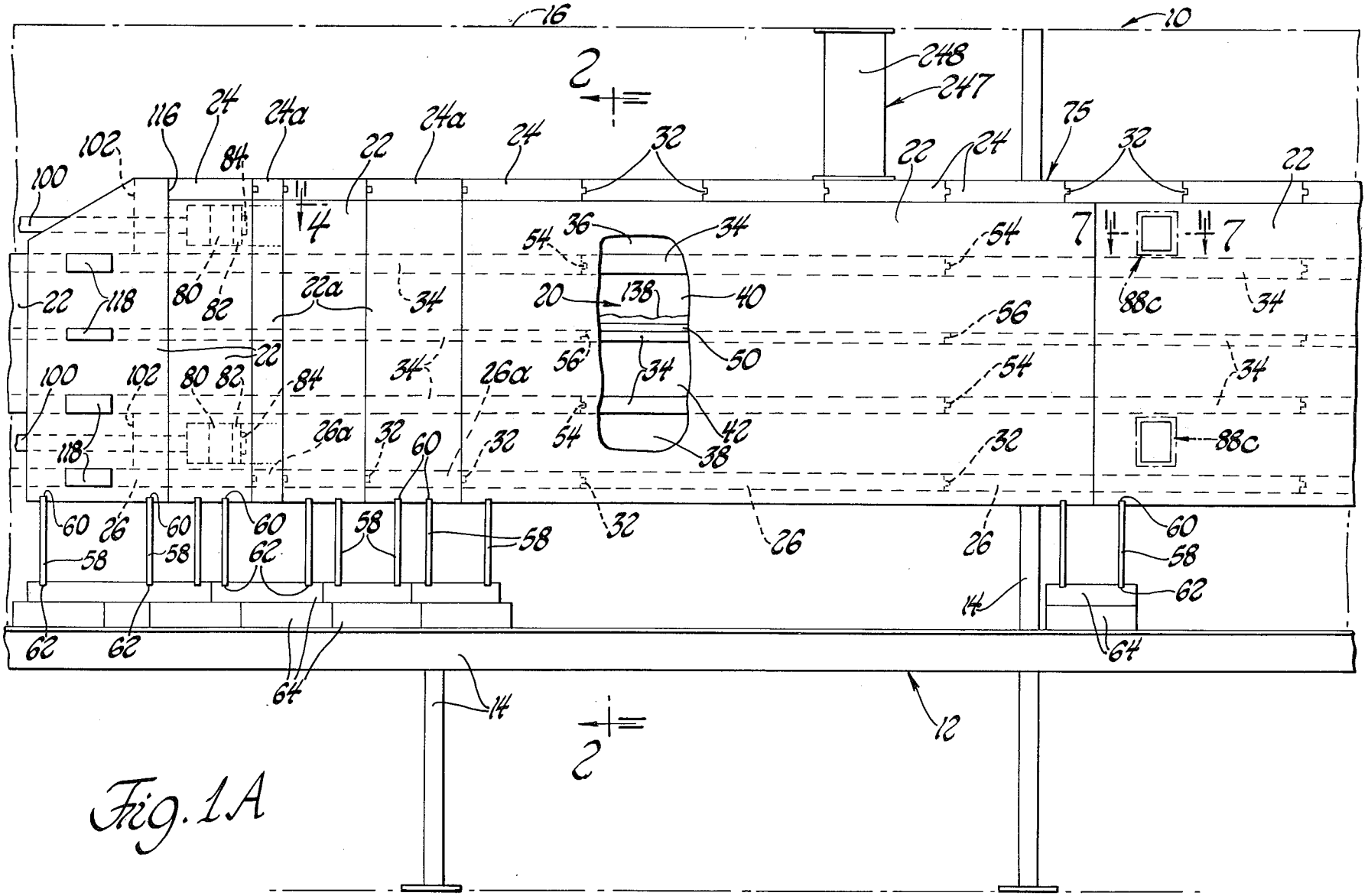
Figure 1B:
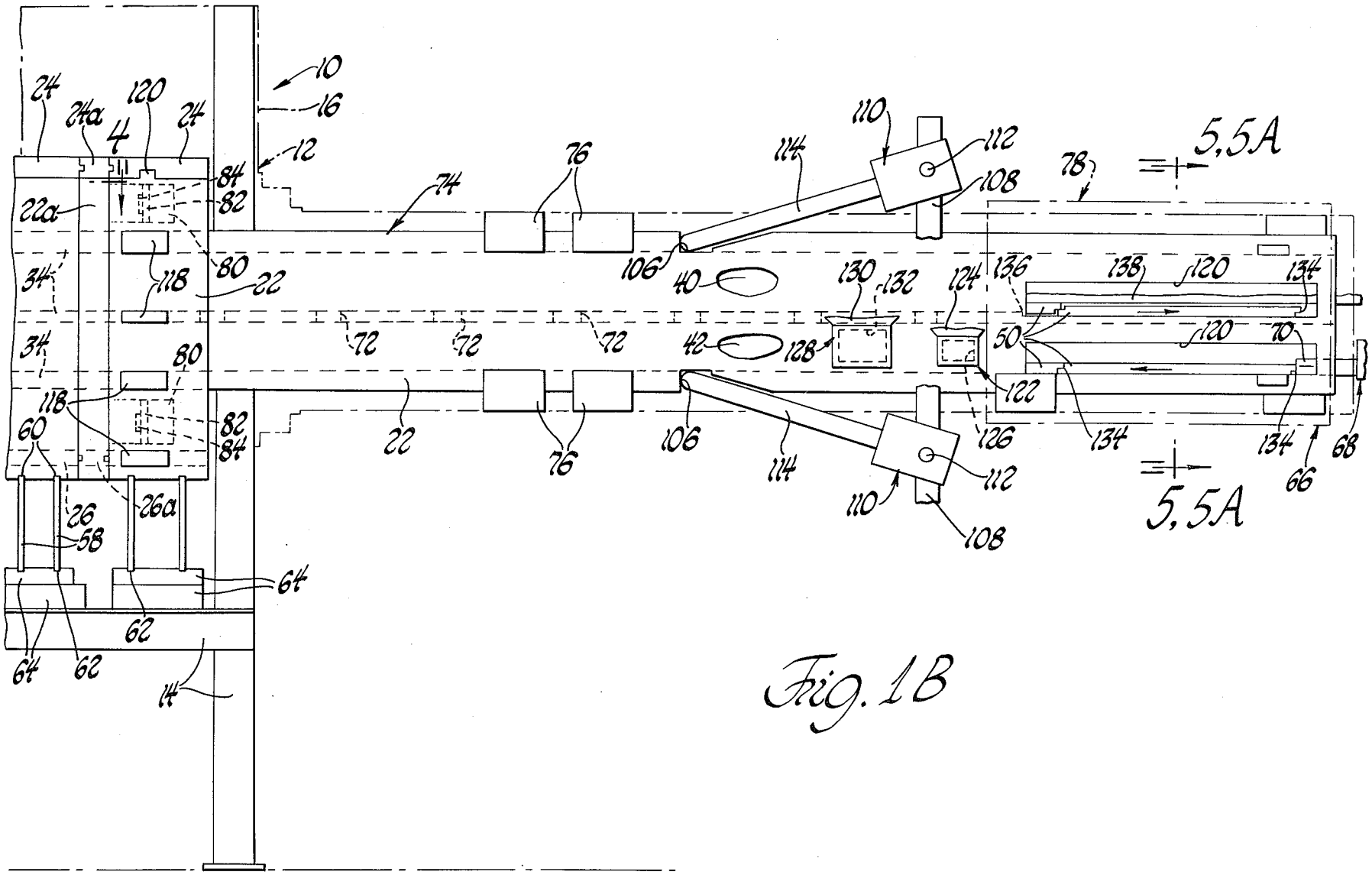
Figure 2:
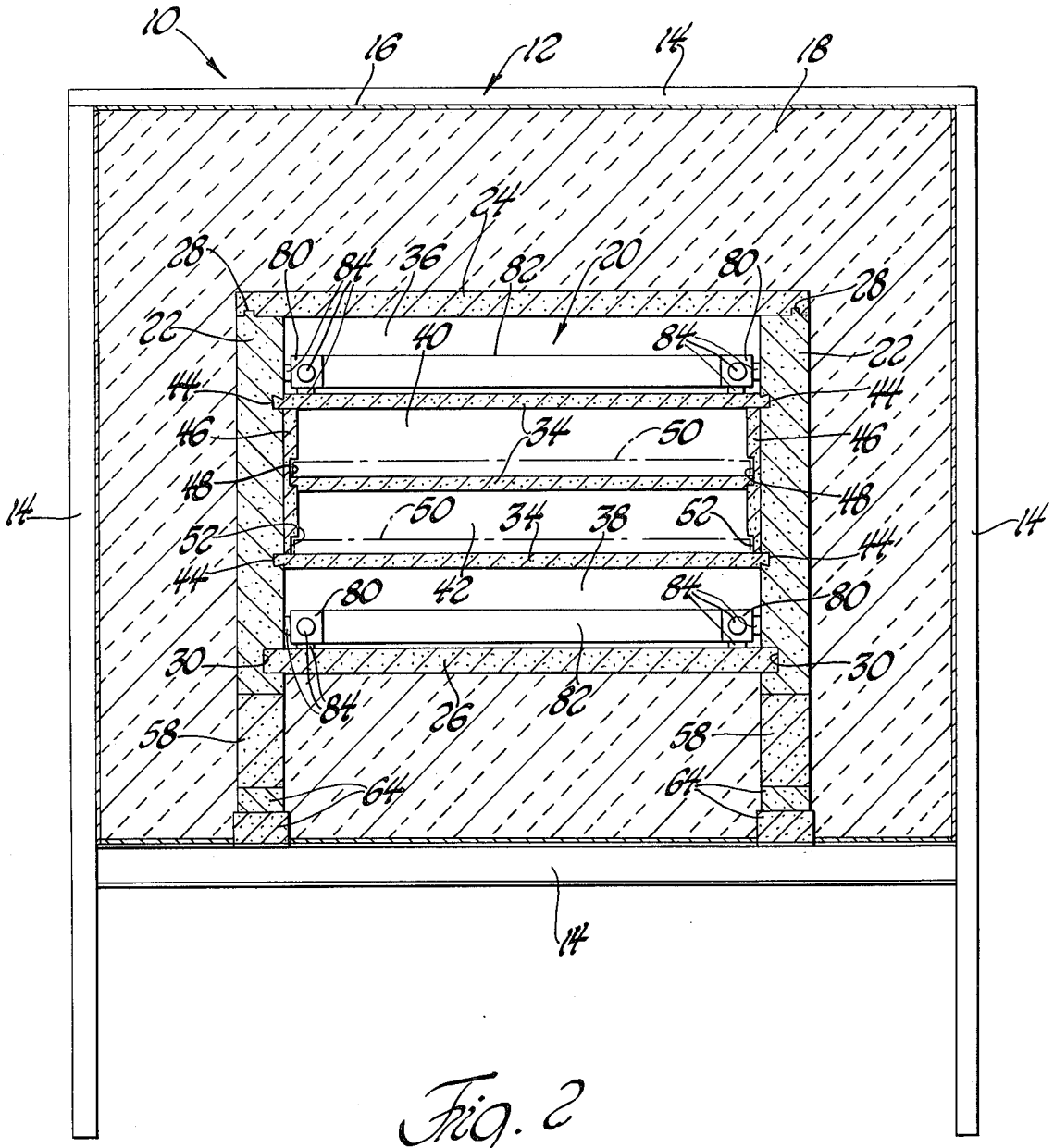
FIG. 2 is a cross-sectional view of the furnace taken along line 2—2 of FIG. 1A.

With combined reference to the side elevation view cooperatively shown by FIGS. 1, 1A, and 1B and to the cross-sectional view of FIG. 2, a high temperature furnace embodying the present invention is collectively indicated by 10 and includes a housing 12 within which products are heated. Relatively high heating temperatures are possible due to the construction of the furnace and the materials utilized. For example, crystalline silica can be fused by the furnace at a temperature between 3100° and 3200° F. In fact, the only materials directly subjected to the maximum furnace heat are graphite and boron nitride which can withstand temperatures above 5000° F.

Housing 12 has an elongated shape and includes a framework of various longitudinal, transverse, and vertical support beams 14 that support an outer sheet metal skin 16. Within the skin 16, as can be seen in FIG. 2, carbon black powder insulation 18 surrounds and insulates a heating chamber 20 that is defined by various graphite wall panels. Laterally spaced side wall graphite panels 22 of varying lengths along the longitudinal extent of the furnace define the lateral extremities of the heating chamber while top and bottom graphite wall panels 24 and 26, respectively, define the upper and lower extremities of the heating chamber. It will be noted that the upper edges of the side wall panels 22 have interlocking tongue and groove connections 28 with the lateral edges of the top wall panels 24 so as to prevent outward movement of the side wall panels. Lower ends of the side wall panels 22 include inwardly facing grooves 30 that receive and thereby support the lateral edges of the bottom wall panels 26. Also, it will be noted in FIG. 1A that the longitudinal edges of the top and bottom wall panels 24 and 26 include interlocking tongue and groove connections 32, and the longitudinal edges of the side wall panels 22 have similar interlocking tongue and groove connections.

Within the heating chamber 20 as seen in FIG. 2, horizontal separating wall panels 34 of graphite provide walls that divide the chamber into top and bottom heating portions 36 and 38 and top and bottom conveying passages 40 and 42 between the heating portions. Interlocking bevel connections 44 between the side wall panels 22 and the lateral edges of the upper and lower separating wall panels 34 cooperate with the top wall panels 24 in preventing outward side wall movement. Graphite side wall liners 46 are located between the upper and lower separating wall panels 34 and have intermediate grooves 48 that open toward each other to receive the lateral edges of the intermediate separating wall panels 34. Above the intermediate separating wall panels 34, liner grooves 48 receive and guide lateral edges of conveying trays 50 used to convey products through the top conveying passage 40. Likewise, lower edge portions of side wall liners 46 define grooves 52 that receive and guide lateral edges of conveying trays 50 that convey products through the bottom,conveying passage 42. Also, it will be noted in FIG. 1A that the longitudinal edges of the upper and lower separating wall panels 34 are interlocked by tongue and groove connections 54 while the longitudinal edges of the intermediate separating wall panels 34 are interlocked by overlapping connections 56. Graphite support struts 58 have upper ends received by notches 60 (FIG. 1A) in the lower edges of side wall panels 22 and have lower ends received by notches 62 in fused silica blocks 64 mounted on the framework support structure provided by beams 14.

With reference to the side elevation view cooperatively provided by FIGS. 1, 1A and 1B, furnace 10 includes a conveyor collectively indicated by 66 for moving the graphite conveying trays 50 through the top and bottom conveying passages 40 and 42. Conveyor 66 includes right and left-hand pushers 68 at the right and left-hand ends of the furnace. Pushing arms 70 of the pushers 68 push the graphite trays 50 through the heating chamber 20 of the furnace in an end-to-end fashion. Left-hand pusher 68 (FIG. 1) and its associated pushing arm 70 move the graphite trays 50 from the left toward the right through the upper conveying passage 40, while the right-hand pusher 68 (FIG. 1B) and its pushing arm 70 move the trays 50 from the right toward the left through the lower conveying passage 42. Furnace 10 is thus of the "counterflow" type in which the cooler products to be heated entering the furnace are heated by the hotter adjacent products exiting the furnace. In this connection, it should be noted that the intermediate horizontal separating wall panels 34 define openings 72 that aid in heat transfer between the two conveying passages at longitudinal ends 74 of the furnace. The longitudinal furnace ends 74 have a reduced size relative to the furnace central portion 75 (FIG. 1B) since the top and bottom heating portion 36 and 38 terminate before reaching these ends. Much higher temperatures are present at the central portion 75 of the furnace between the ends 74 which function mainly to achieve the counterflow heat transfer previously discussed. To limit the heat flow from the hotter central furnace portion 75 toward the longitudinal ends 74, various porous carbon wall panels 22*a*, 24*a*, and 26*a* as shown in FIGS. 1A and 1B are substituted for the graphite panels at selected locations adjacent the longitudinal furnace ends 74. Fused silica foam blocks 76 of L shape (FIGS. 1, 1B and 5) space the graphite wall panels at the furnace ends 74 from the outer sheet metal housing skin 16. Felt insulation (not shown) limits heat transfer to the environment from the conveying passages at the furnace ends 74. After each graphite conveying tray 50 has been moved through the furnace, schematically indicated transfer mechanisms 78 at the furnace ends 74 transfer the trays from one conveying passage to the other in a manner that is subsequently described.

Figure 3:
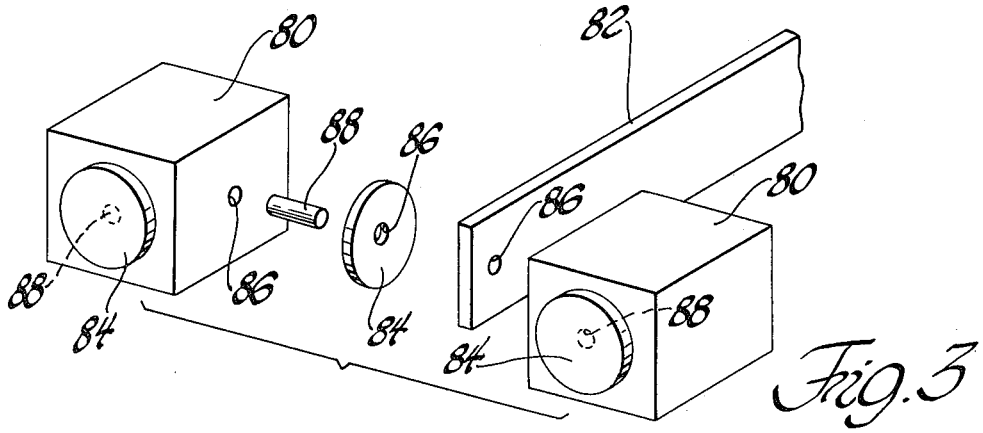
FIG. 3 is an exploded perspective view of conductive elements and insulators that cooperate to provide heating of the furnace.

As seen in FIG. 2, the heating portions 36 and 38 of chamber 20 receive electrically conductive elements and insulators for establishing an electrical flow path that provides heating of the chamber. The electrical conductive elements are made of graphite and include spacer blocks 80 (see also FIG. 3) and elongated heater bars 82. Boron nitride is used to make the insulators which are indicated by 84 and have round disc shapes that minimize the total amount of boron nitride required. Various holes 86 in the spacer blocks 80, heater bars 82, and insulators 84 receive associated boron nitride plugs 88 (FIG. 3) that locate and position the insulators relative to the conductive elements as well as positioning the conductive elements relative to each other. In addition to spacing the conductive elements 80 and 82 from each other at various locations, as is subsequently described, the insulators also space the conductive elements from the housing wall panels as can be seen in FIG. 2. In the top heating portion 36 of the chamber, the insulators 84 space the conductive elements upwardly from the upper separating wall panels 34 and from the side wall panels 22. Likewise, in the lower heating portion 38 of the chamber, the insulators 84 space the conductive elements upwardly from the bottom wall panels 26 and from the side wall panels 22.

Figure 4:
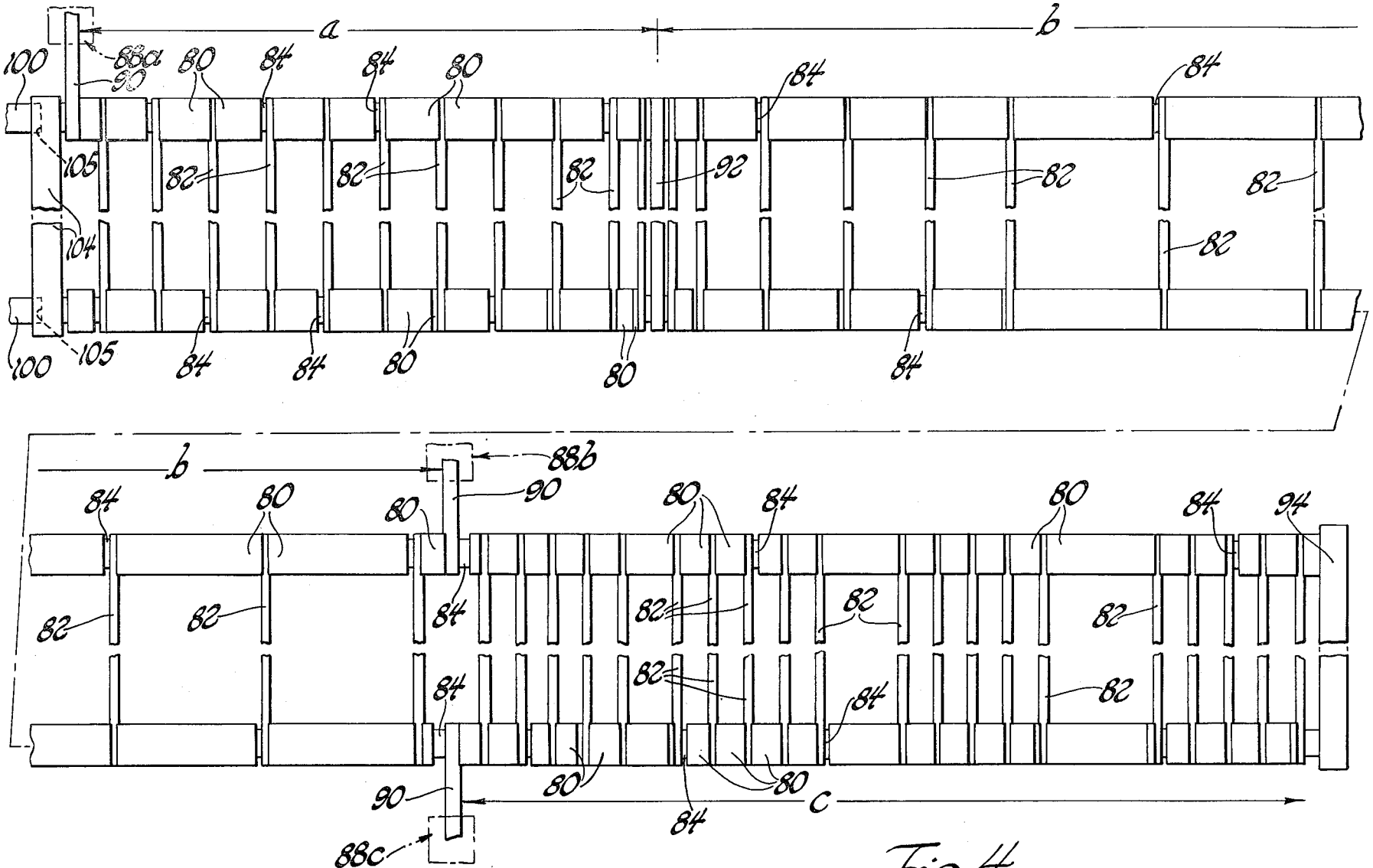
FIG. 4 is a top plan view of the conductive elements and insulators taken along line 4—4 of FIGS. 1A and 1B.

As can be seen in FIG. 4, the electrically conductive elements 80 and 82 and the insulators 84 received within the top heating portion 36 of the chamber cooperate to provide a preheat section *a*, a central heating section *b*, and an exit heating section *c*. Likewise, although it is not shown in the drawings, the conductive elements and insulators received within the bottom heating portion 38 of the chamber also provide a preheating section, a central heating section, and an exit heating section. Of course, due to the counterflow conveyance of products through the furnace, the three heating sections of the bottom heating portion are oriented in the opposite direction as those of the top heating portion. In each of the heating sections, the conductive spacer blocks 80 are arranged in rows at the lateral sides of the chamber heating portion and the heater bars 82 extend laterally therebetween with their ends situated between the spacer blocks. Insulators 84 are also positioned between certain of the spacer blocks 80 and the adjacent ends of the heater bars 82 so as to establish a serpentine flow path for electricity through the conductive elements. Electrical terminals schematically indicated by 88*a*, 88*b*, and 88*c* for the three heating sections include respective terminal bars 90 that supply electric current to the conductive elements. Between the terminals 88*a* and 88*b* of the preheating section *a* and central heating section *b*, a common grounding bar 92 completes the paths of current flow for both of these heating sections. An AC voltage is applied across the terminals 88*a* and 88*b* to provide heating of sections *a* and *b*. Likewise, an AC voltage is applied across terminal 88*c* and an entrance section terminal of the lower heating portion of the chamber with a graphite end wall panel 94 of the furnace functioning as a grounding bar for the conductive elements electrically intermediate these terminals. Heating of the sections associated with these terminals (the exit section of the top chamber portion and the entrance section of the lower chamber portion) thus takes place. For a given number of terminals and a specified power input, the use of the grounding bars between the terminals permits the maximum voltage between ground and any conductive element to be only half what it would be if the power was applied with one of the terminals at ground. The likelihood of arcing between the conductive elements and the grounded wall panels is thus reduced. It will be noted that certain of the heater bars 82 are in an electrically parallel relationship with one or more other heater bars and thereby vary the total resistance of the conductive elements in the heating sections. Varying the voltage applied across the terminals varies the power input and the consequent temperature to which the furnace is heated.

As seen by combined reference to FIGS. 1, 1A and 4, retractable and extendable gas cylinders 96 are mounted on vertical beams 14 at each lateral side of the system (only one side shown) in alignment with the rows of spacer blocks 80 and include piston rods 98 that bias graphite connecting rods 100 toward the right. These graphite connecting rods 100, as can be seen in FIG. 1A, extend through graphite end walls 102 into the heating portions 36 and 38 of the heating chamber in alignment with the laterally spaced rows of conductive spacer blocks 80 as shown in FIG. 4. A movable graphite slab 104 (FIG. 4) includes holes 105 that receive the inner ends of rods 100 and allows the resilient bias supplied to the rods by their associated gas cylinders to compress the rows of spacer blocks 80 against the right-hand end wall 94 of the chamber heating portion. The resilient compression of the spacer blocks 80 also compresses the ends of the heater bars 82 and the insulators 84 so as to position the heating components with respect to each other in a sandwiched relationship. Since the only components located within the heating chamber defined by the graphite walls are the graphite conductive elements 80 and 82 and the boron nitride insulators 84, very high heating temperatures can be generated. As these high temperatures are generated and the conductive elements 80 and 82 as well as the insulators 84 expand, the resilient gas cylinders 96 shown in FIG. 1 allow such expansion as their piston rod 98 is retracted. During such retraction, the conductive elements and insulators slide relative to the heating chamber walls. Upon cooling, the piston rods are extended as the conductive elements and insulators contract.

The manner in which the conductive elements 80 and 82 and the insulators 84 are positioned relative to each other by the gas cylinders permits more electrical elements to be connected to each other to provide a greater resistance than has been heretofore possible. As such, a greater voltage can be utilized and applied over a fewer number of terminals. Since the terminals are the locations where greatest heat flow to the environment takes place, a lesser number of terminals is advantageous in that high temperatures within the furnace can be achieved.

As seen in FIGS. 1 and 1B, the longitudinal furnace ends 74 include relatively long side wall panels 22 with notches 106 facing upwardly and downwardly. A frame 108 adjacent each furnace end supports a pair of resilient gas cylinders 110 by pivot pins 112 at each lateral side of the furnace (only one side shown). Piston rods 114 of the gas cylinders 112 are received within the side wall notches 106 so that suitable pressurized gas, such as compressed air, supplied to the cylinders biases the side wall panels 22 and 22*a* inwardly toward the longitudinal center of the housing. Such biasing maintains the interlocking relationship of the side wall panels and positioning thereof relative to each other while allowing longitudinal expansion during heating. Since the biasing is in both directions, the expansion occurs about the longitudinal center of the housing and concomitant therewith the graphite struts 58 pivot about their lower ends to permit the movement of the side wall panels. For a furnace whose total length is approximately 40 feet and which is heated to approximately 3200° F., the total expansion that must be accommodated for at each cylinder 110 is approximately 1½ inches.

As seen in FIG. 1A, the top wall panel 24 furthest to the left is engaged at 116 by the adjacent side wall panel 22 at each side of the furnace so as to be biased toward the right due to the resilient cylinder biasing of the side wall panels. Similarly, lateral projections 118 of the adjacent bottom wall panel 26 and separating wall panels 34 are received within associated openings in this same side wall panel 22 so as to likewise be biased inwardly toward the longitudinal center of the furnace. Like projections 118 of the bottom wall panel 26 at the right-hand end of the central furnace portion (see the left-hand portion of FIG. 1B) and of the separating wall panels 34 are received within openings in the adjacent side wall panel 22 so as to also be biased inwardly toward the longitudinal center of the furnace housing. The upper edge of this side wall panel 22 also includes an upward projection 120 that is received within an opening of the adjacent top wall panel 24 to provide biasing thereof toward the left through the resilient gas cylinder bias.

As seen by reference to FIGS. 1 and 1B, the longitudinal furnace ends 74 have openings 120 in the side wall panels 22 adjacent the transfer mechanisms 78 so that the trays 50 can be indexed into and out of the conveying passages 40 and 42 in a manner that is subsequently described. As herein disclosed, the furnace 10 is used to fuse crystalline silica into an amorphous material. For this application, each conveying passage has an associated parting agent feeder 122 for supplying powdered carbon black from a bin 124 through a side wall opening 126 onto the upper side of the trays 50. Graphite, silicon carbide and boron nitride can also be used for the parting agent. The carbon black is deposited on the trays uniformly with a thickness of approximately one-eighth of an inch and prevents the trays from reacting with the crystalline silica to form silicon carbide. Just downstream from the carbon black feeders 122, the conveying passages include crystalline silica feeders 128 that supply the trays with crystalline silica from a bin 130 through a side wall opening 132. It should be noted that the graphite trays 50 have overlapping leading and trailing edges 134 which prevent the carbon black parting agent and the crystalline silica from falling down between the trays onto the lower graphite panels providing the conveying passage floors. Also, adjacent the ends of the conveying passages after passage through the furnace, the trays approach recesses 136 on the order of one eighth inch or so in the bottom floor defining conveying passage wall panels 34. These recesses 136 allow the trays to move downwardly and separate from the fused silica 138 that has just passed through the furnace. At the right-hand end, the overlapping leading and trailing edges 134 of the trays move downwardly freely as shown in FIG. 1B, while at the left-hand end (as shown in FIG. 1) the leading edge of each tray falls downwardly while its trailing edge is held upwardly by its overlapping relationship with the leading edge of the following tray.

Figure 5:
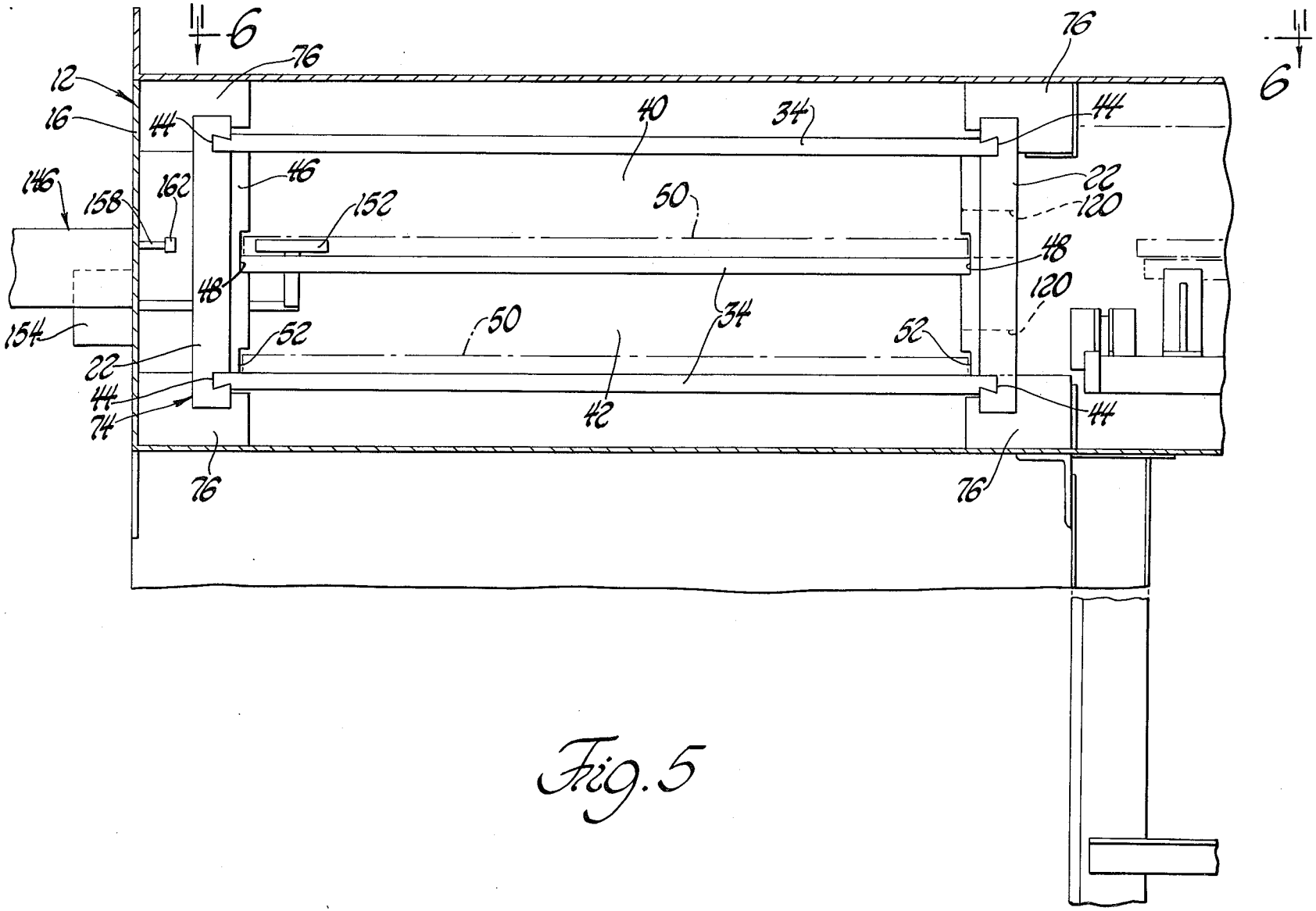
FIGS. 5 and 5A aligned with each other cooperate to provide a sectional view taken along line 5,5A—5,5A of FIG. 1B through a conveyor transfer mechanism of the furnace.
Figure 5A:
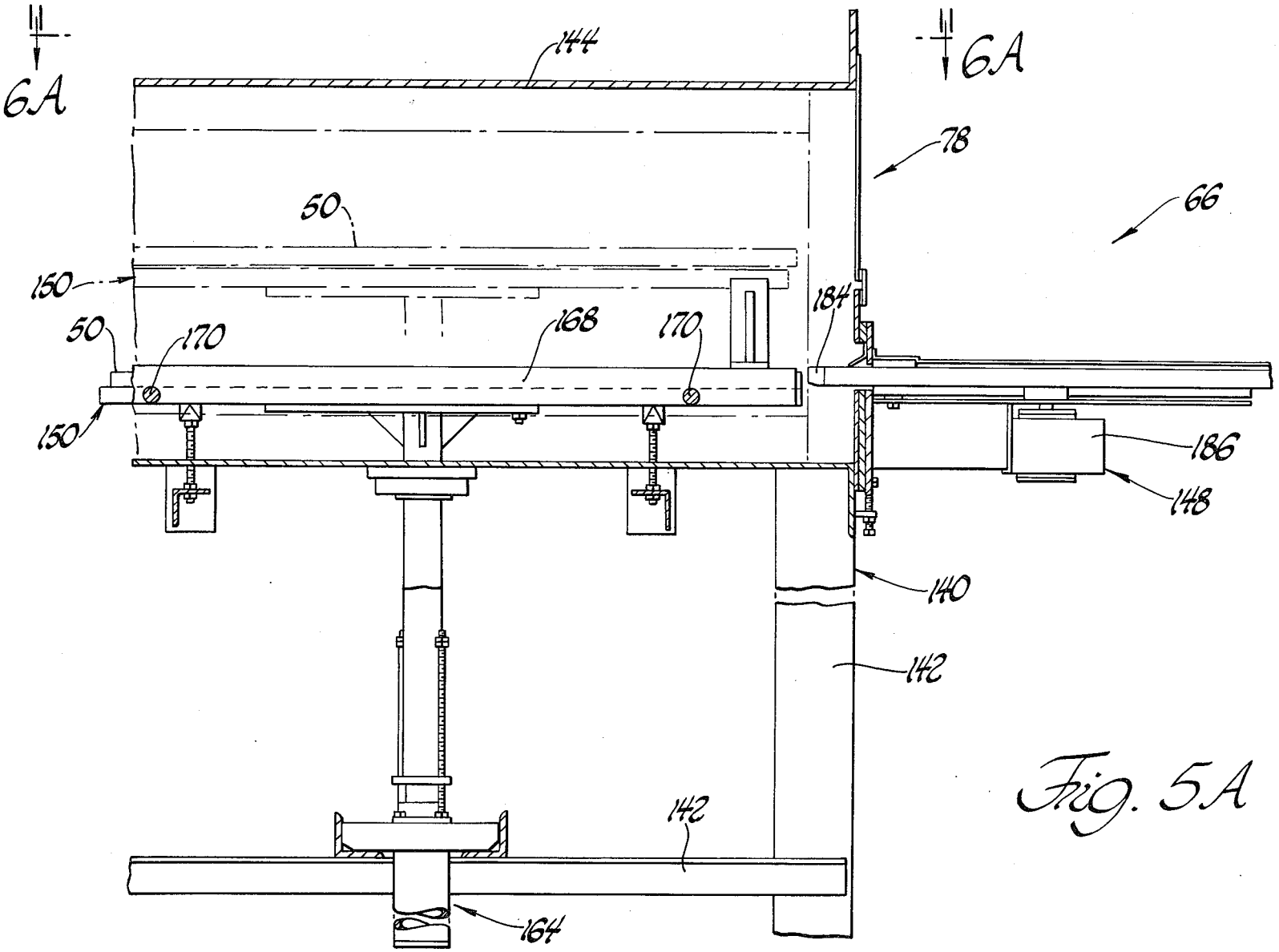
Figure 6:
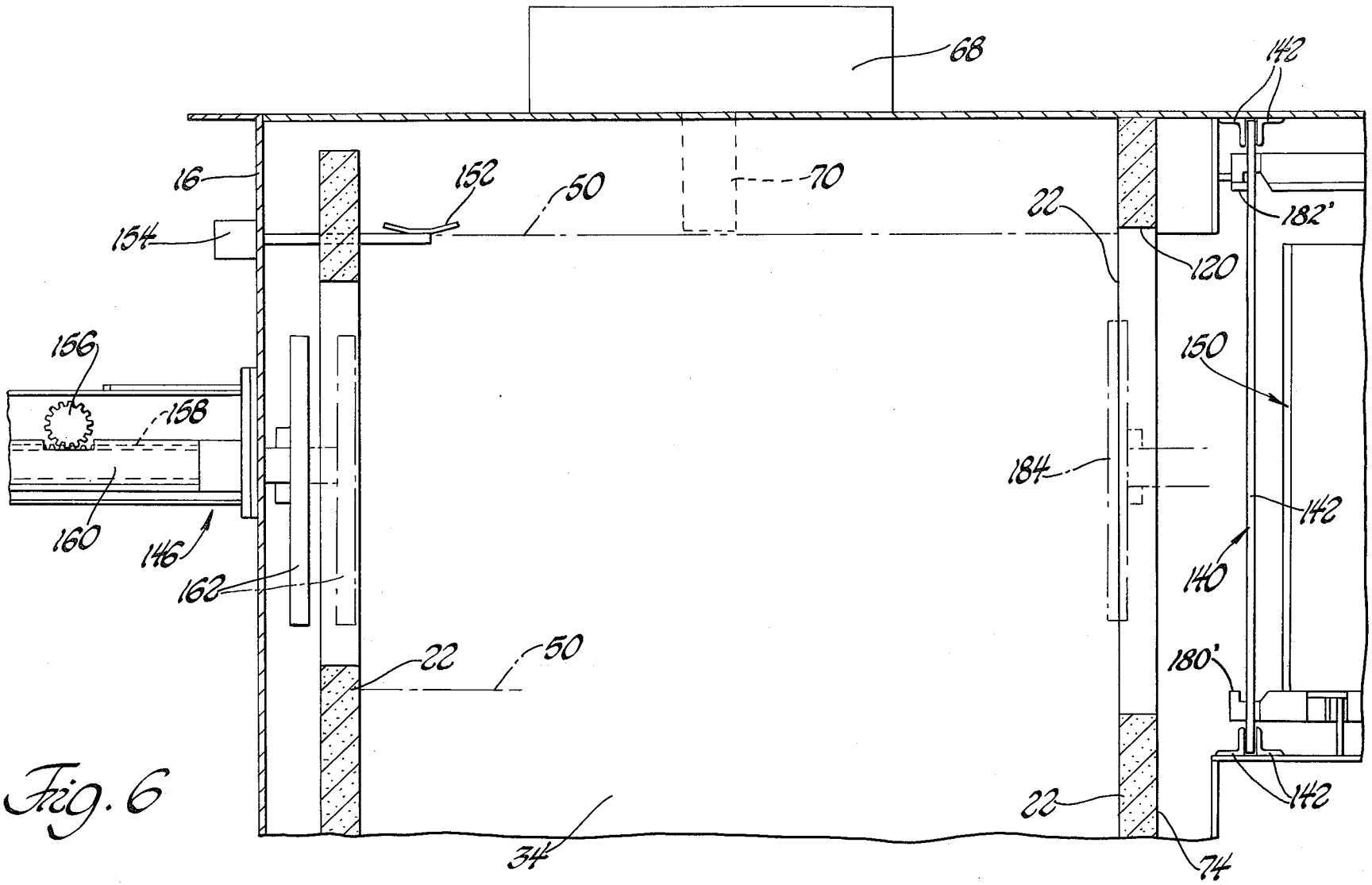
FIGS. 6 and 6A cooperate to provide a plan view of the conveyor transfer mechanism and are taken along line 6—6A of FIGS. 5 and 5A.
Figure 6A:
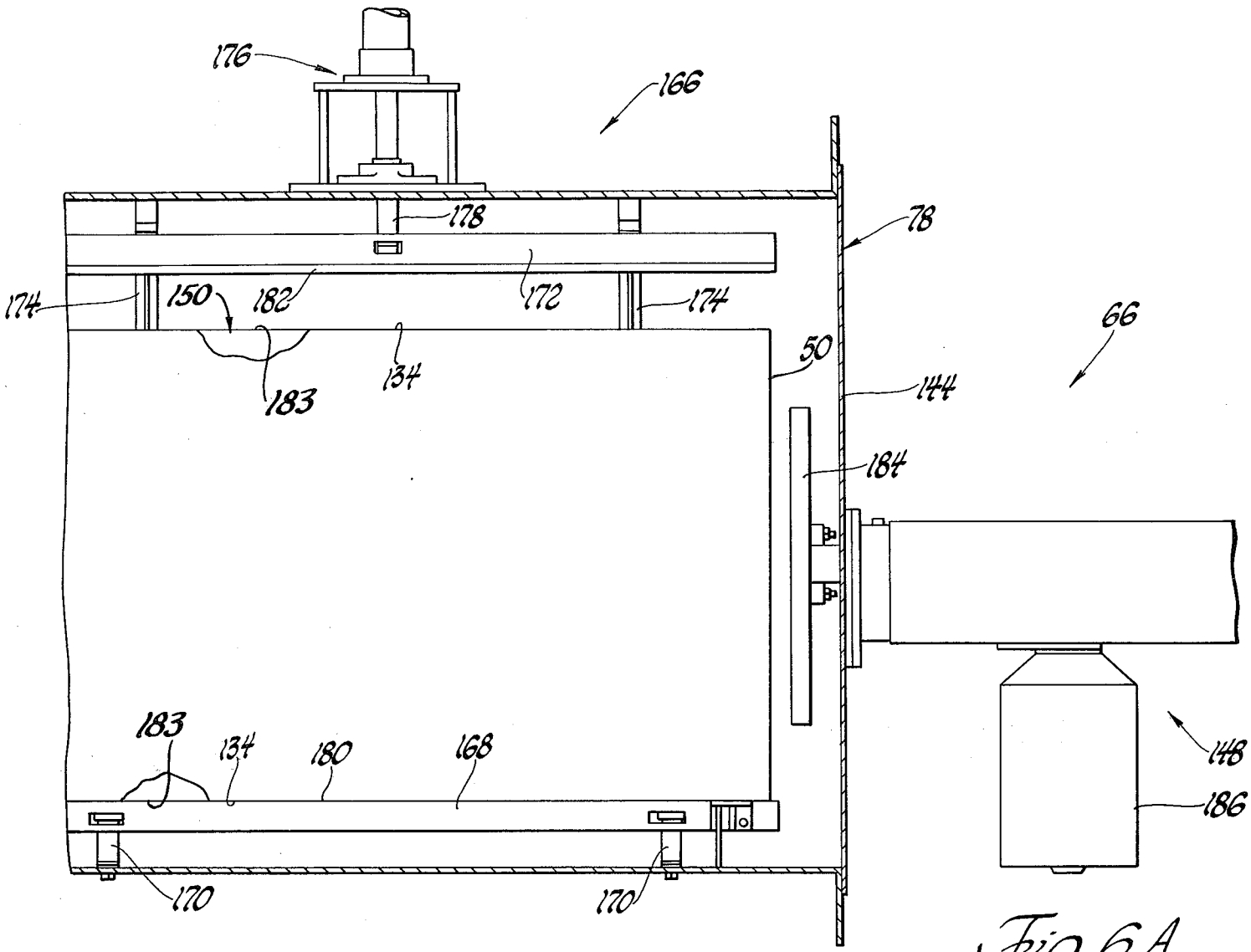

With reference to FIGS. 5, 5A, 6 and 6A, the tray transfer mechanism 78 at the FIG. 1B right-hand end of the furnace will now be described with the understanding that the other transfer mechanism functions in a similar manner. The shown transfer mechanism 78 includes a support frame 140 of various horizontal and vertical frame members 142 that are enclosed within a sheet metal box-shaped skin portion 144 of the housing skin 16. A tray indexer of the transfer mechanism includes an exit indexer 146 (FIGS. 5 and 6) and an entrance indexer 148 (FIGS. 5A and 6A). A vertically movable table 150 of the transfer mechanism receives the trays 50 as they are indexed out of the upper conveying passage 40 by the exit indexer 146 and moves the trays downwardly ready for indexing back into the lower conveying passage 42 by the entrance indexer 148.

As seen in FIGS. 5 and 6, an actuator arm 152 of a limit switch 154 is actuated by the leading edges of the trays 50 as they approach the end of the chamber through the upper conveying passage 40. Switch 154 is coupled to the exit indexer 146 so that its actuation activates the exit indexer. An electric motor driven pinion 156 of indexer 146 (FIG. 6) drives a gear rack 158 received within a tubular guide 160. An indexing arm 162 is secured to the right-hand end of the gear rack 158 and engages the lateral edge of each tray 50 to push it toward the right out of the upper conveying passage 40 through the adjacent side wall opening 120 (FIG. 5). As the tray 50 is pushed out of the conveying passage 40, table 150 is located in its upper position shown by phantom lines in FIG. 5A so that the tray slides onto the table. An extendable and retractable gas cylinder 164 (FIG. 5A) supports the table 150 for vertical movement. After indexing of the tray out of the upper conveying passage 40, the cylinder 164 moves the table 150 downwardly to its solid line position.

As the table reaches its lower position, a cleaner collectively indicated by 166 in FIG. 6A is automatically actuated by suitable switching circuitry. Cleaner 166 includes a fixed scraper bar 168 mounted on the sheet metal housing portion 144 by mounts 170 (FIGS. 5A and 6A). A movable scraper bar 172 (FIG. 6A) of cleaner 166 is mounted on guides 174 for movement toward and away from the trays 50. As the trays 50 move downwardly, the scraper bar 172 is retracted as shown. Movement of scraper bar 172 toward and away from the tray 50 is controlled by a cylinder 176 whose piston rod 178 is connected to scraper bar 172. Prior to indexing of the tray 50 into the lower conveying passage 42 by the entrance indexer 148, cylinder 176 of cleaner 166 is supplied fluid to extend its piston rod 178 and move the scraper bar 172 toward the tray 50. Scraper bars 168 and 172 have elongated guide portions defined by lateral edges 180 and 182 (FIG. 6A) that conform to the overlapping edge shape of the leading and trailing tray edges 134 and also have scraper portions 180' and 182' (FIG. 6) located slightly closer to each other than the edges 180 and 182 (by a few thousandths of an inch). Sufficient pressure is supplied by the cylinder 176 so that movement of the tray 50 by the entrance indexer 148 causes the scraper portions 180' and 182' to scrape the tray edges 134 and clean them of any carbon black parting agent, silica, or silicon carbide that may have formed on the edges. As the scraping takes place, opposite edges 183 of the table 150 (FIG. 6A) engage the scraper bar guide edges 180 and 182 so that the table functions as a gauge to prevent the biasing cylinder 176 and the scraper portions 180' and 182' from causing excessive removal of the graphite tray material at the tray edges 134. Indexing of the tray 50 as it is scraped is provided by an indexing arm 184 of entrance indexer 148. This arm 184 is driven by an electric motor 186 (FIG. 5A) through a pinion and gear rack drive similar to the exit indexer 146 previously described. After the tray has been indexed into the lower conveying passage 42 and the indexing arm 184 has been retracted back from its phantom line position of FIG. 6 to its solid line position of FIG. 6A, table 150 is moved vertically to the upper phantom line position of FIG. 5A ready to receive another tray.

Pushers 68 shown in FIGS. 1 and 1B move their respective pushing arm 70 for a stroke length approximately equal to the length of each graphite tray 50. After being extended for a full stroke length by the associated pusher 68, each pushing arm 70 is retracted ready for pushing the next tray as it is indexed into the associated conveying passage in the manner previously described. The full furnace conveying passage length of trays is thus moved by each pushing arm 70 with the edges of the trays guided by the side wall liner grooves 48 and 52 shown in FIG. 2. When silica is being fused while conveyed at a rate of approximately 6 inches per minute, it has been found that no problems occur due to the momentary pause of conveyance as the pushing arm 70 is retracted during the indexing of the next tray into the conveying passage.

Figure 7:
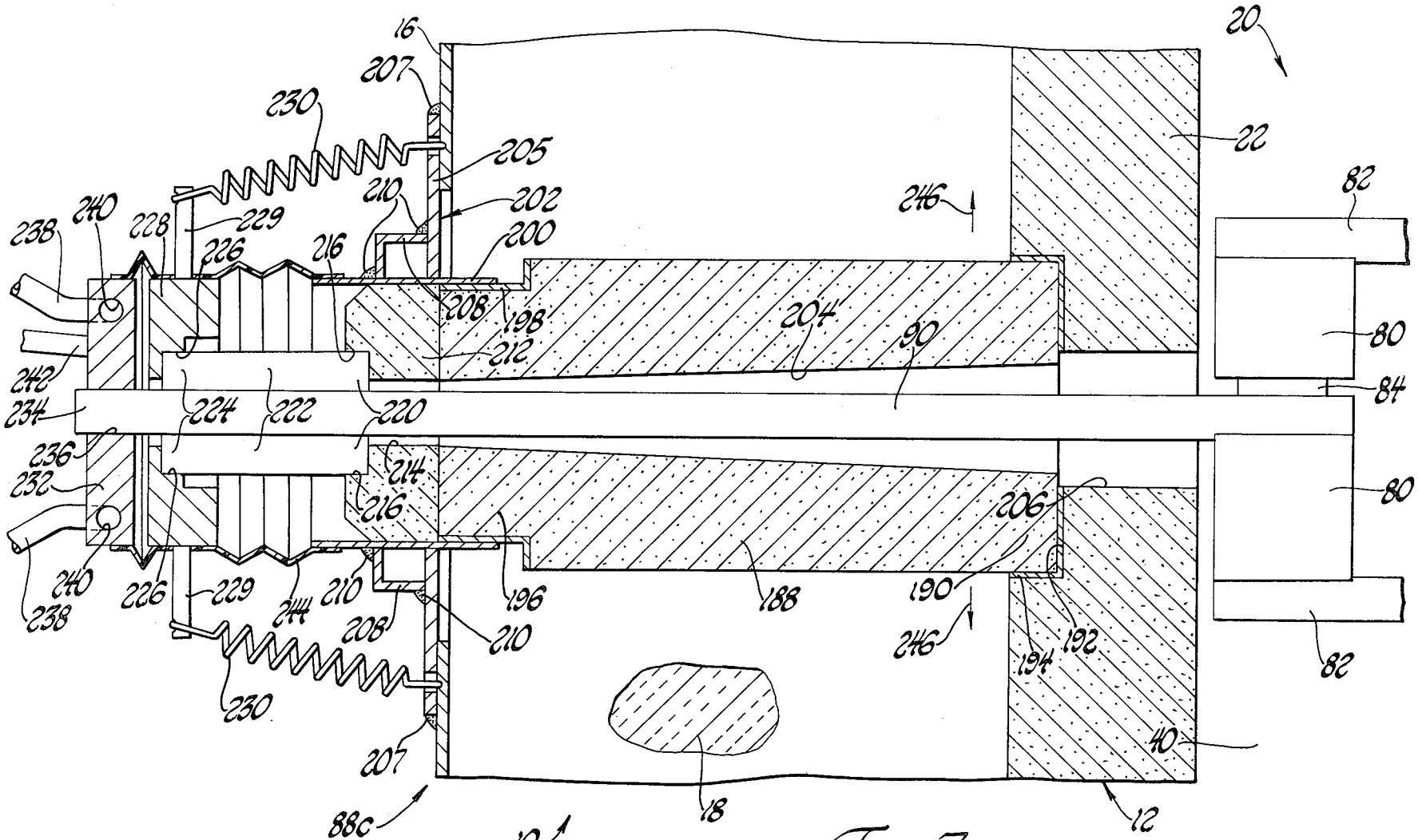
FIG. 7 is a sectional view taken through an electrical terminal of the furnace along line 7—7 of FIG. 1A.

With reference to FIG. 7, electrical terminal **88*c* is further illustrated with the understanding that the other electric terminals of the furnace have the same construction. A porous carbon passage tube 188 of the terminal has an inner end 190 received within a recess 192 in the heating chamber side wall panel 22, with a high temperature gasket 194 interposed between the side wall panel and the passage tube. An outer end 196 of passage tube 188 also includes a high temperature gasket 198 and is received by an annular flange 200 of a centering ring mount 202 on the outer housing skin 16. Between its inner and outer ends, passage tube 188** defines an opening 204 with a larger size at its inner end than at its outer end. Terminal bar 90 extends through the opening 204 and through a side wall opening 206 into the heating portion of the furnace chamber to be electrically connected to the conductive graphite spacer blocks and heater bars 80 and 82 in the manner previously described. It should be noted that the terminal bar 90 is spaced from both the side wall panel 22 and the porous carbon tube 188 so as not to be electrically grounded.

Centering ring mount 202 includes an apertured plate 205 that is secured to the furnace housing skin 16 by welds 207. An annular ring 208 of an L-shaped cross section is secured to flange 200 of the mount and to plate 205 by welds 210 and provides a passage for water cooling. A graphite centering ring 212 is received within the annular shape of the centering ring mount flange 200 and is seated against the outer end 196 of passage tube 188. Terminal bar 90 extends inwardly through an opening 214 in the centering ring in a spaced relationship thereto so as not to be electrically grounded. Recesses 216 in the centering ring receive inner ends 220 of respective fused silica spacers 222. Outer ends 224 of spacers 222 are received within associated recesses 226 in an aluminum mounting ring 228. Upper and lower fused silica spacers (not shown) supported by the centering ring 212 and the mounting ring 228 are also used to vertically locate the terminal bar 90. Spring attachment arms 229 of ring 228 extend outwardly to attach outer ends of helical springs 230 whose inner ends are secured to the mount plate 205. Pressure applied by springs 230 biases mounting ring 228 inwardly so that the spacers 222 are thereby maintained within the recesses 216 and 226 with the centering ring 212 compressed against the outer passage tube end 196. Mounting of the terminal bar 90 in isolation from ground is thus achieved. The spring pressure also compresses the passage tube inner end 190 against the heating chamber side wall panel 22 to prevent the carbon black powder from entering the tube opening 204. An electrical terminal block 232 of brass receives the extreme outer end 234 of terminal bar 90 in an opening 236 with a slight interference fit so as to secure the block relative to the bar. Entrance and exit water tubes 238 provide for flow of cooling water through a block passage 240 while a cable 242 connected to the block applies an AC voltage to it from a transformer. A seal 244 extends from the terminal block 232 to the centering ring mount flange 200 and encloses the mounting ring 224 and the spacers 222 in an atmospherically sealed manner.

During thermal expansion and contraction of the heating chamber side walls 22 and the electrically conductive spacer blocks and heater bars 80 and 82, the terminal passage tube 188 shown in FIG. 7 pivots about its outer end 196 in the direction shown by arrows 246 to accommodate for such expansion. Since the terminal bar 90 moves a greater extent at its inner end than at its outer end, the larger size of the passage tube opening 204 at its inner end reduces the possibility of terminal bar grounding to the tube. At its outer end, the smaller size of the tube opening 204 prevents heat flow through the tube opening to the environment.

During operation of the furnace 10 in fusing silica, it is preferable for the heating chamber 20 to be continuously supplied with a slight pressure of a quarter inch or so above atmosphere of nitrogen so that oxidation is minimized. Also, an optical temperature sensor 247 shown in FIG. 1A is used to sense the temperature within the heating chamber 20. This sensor includes a porous carbon tube 248 which reduces the heat flow to the environment while providing a passage through which the temperature can be optically sensed. A number of such sensors can be used to sense the temperature at each heating section *a*, *b* and *c* shown in FIG. 4 if desired so as to give accurate temperature sensing along the total length of conveyance.

While a preferred embodiment of the furnace has herein been described in detail, those familiar with the art will recognize various alternative designs and embodiments for practicing the present invention as defined by the following claims.

What is claimed is:

1. A high temperature furnace comprising: a housing defining an insulated heating chamber; a plurality of electrically conductive elements received within the heating chamber; a plurality of electrical insulators positioned between the conductive elements at selected locations; the conductive elements being engaged with each other to establish an electrical flow path therethrough for heating the chamber and said insulators cooperating with the conductive elements to control the direction of the electrical flow path; resilient means located externally of the housing; and connecting means extending between the conductive elements within the heating chamber and the resilient means so as to cooperate therewith in compressing the conductive elements and the insulators therebetween whereby the conductive elements and insulators are positioned relative to each other while being allowed to expand during heating of the chamber.

2. A furnace as in claim 1 wherein the housing includes wall panels defining the heating chamber, and second resilient means for compressing the wall panels while allowing expansion thereof during heating of the chamber.

3. A furnace as in claim 2 wherein the wall panels are made of graphite and include interlocking edges.

4. A furnace as in claim 3 wherein the housing includes graphite separating wall panels that divide the heating chamber into a conveying passage for receiving products to be heated and a heating portion that receives the conductive elements and the insulators.

5. A furnace as in claim 1 wherein the housing includes graphite wall panels defining the heating chamber, the electrically conductive elements being essentially of graphite, and the insulators being of boron nitride.

6. A furnace as in claim 5 further including at least one terminal for supplying electric current to the conductive elements and a grounding bar connected to the conductive elements.

7. A furnace as in claim 5 wherein the electrically conductive elements include spacer blocks and heater bars, and the boron nitride insulators being in the form of round discs.

8. A furnace as in claim 7 further including boron nitride insulators that space the spacer block elements from the graphite wall panels.

9. A furnace as in claim 8 wherein the boron nitride insulator discs and the conductive spacer block and heater bar elements define plug openings, and boron nitride insulator plugs received within the plug openings to locate the boron nitride insulator discs with respect to the conductive spacer block and heater bar elements.

10. A furnace as in claim 1 wherein the resilient means includes an extendable gas cylinder for compressing the conductive elements and the insulators in position.

11. A furnace as in claim 10 wherein the connecting means includes a graphite connecting rod connected to the gas cylinder and extending into the heating chamber to compress the conductive elements and the insulators in position.

12. A furnace as in claim 11 wherein the housing includes wall panels providing an elongated shape thereof, and the housing further including second resilient means having pairs of extendable gas cylinders acting on the wall panels thereof from each end of the housing so that the housing expands and contracts about the longitudinal center thereof.

13. A furnace as in claim 1 further including a conveyor having conveyor trays with leading and trailing edges that overlap each other, means for moving the trays through the heating chamber, and means for cleaning the edges of the trays after passage through the heating chamber.

14. A furnace as in claim 13 wherein the cleaning means includes a pair of spaced scraper bars, each scraper bar having an elongated guide portion and a scraper portion for engaging the leading and trailing edges of the trays, and indexing means for moving the trays between the guide portions of the scraper bars so that the scraping portions thereof clean the leading and trailing edges of the trays.

15. A furnace as in claim 14 including means mounting one of the scraper bars for movement toward and away from the other scraper bar and for biasing said one scraper bar toward the other scraper bar as the indexing means moves a tray therebetween.

16. A furnace as in claim 13 wherein the heating chamber includes two conveying passages, and the conveyor including pushers that move the trays through the conveying passages in opposite directions in a counterflow manner.

17. A furnace as in claim 13 wherein the housing has an elongated shape and includes a horizontal separating wall that divides the heating chamber into two vertically spaced conveying passages which have elongated shapes, the conveyor including pushers that move the trays through the conveying passages in opposite directions in a counterflow manner, a transfer mechanism at each end of the furnace housing for transferring trays from one conveying passage to the other conveying passage, and each transfer mechanism including a vertically movable table for moving the trays vertically.

18. A furnace as in claim 17 wherein each transfer mechanism includes a tray indexer including an exit indexer for moving the trays out of the housing from one conveying passage onto the table in a sideways direction with respect to the direction of conveyance and also including an entrance indexer for moving the trays from the table into the other conveying passage after vertical table movement.

19. A furnace as in claim 18 wherein each transfer mechanism includes scraper bars having elongated guide portions and scraper portions that clean the leading and trailing edges of the trays as the indexer moves the trays back into the housing, means biasing one of the scraper bars toward the other scraper bar, and the table having opposite edges for respectively engaging the scraper bars to prevent the cooperative action of the biasing means and the scraper bars from cutting material from the tray edges during the cleaning.

20. A furnace as in claim 1 wherein the housing has an elongated shape and includes graphite wall panels defining the heating chamber intermediate the ends thereof and porous carbon wall panels adjacent the ends thereof for limiting heat flow from the center of the housing toward the ends thereof.

21. A furnace as in claim 1 wherein the housing has an outer metal skin; insulation received within the metal skin about the heating chamber; and electrical terminals for carrying electricity through the insulation to the conductive elements within the heating chamber, each terminal including a passage tube extending from the metal skin to the heating chamber and having an opening therethrough with a small outer end and a large inner end, an electrically conductive terminal bar received within the tube opening and having an outer end extending outwardly from the housing and an inner end that is compressed by the resilient means in engagement with at least one conductive element, and means mounting the outer end of the terminal bar within the outer end of the passage tube opening in a spaced relationship thereto so that the terminal bar is electrically connected to the conductive elements without contacting the passage tube, the larger inner end of the passage tube opening allowing the terminal bar to carry electricity without engaging the tube during heating of the furnace as the heating chamber and conductive elements expand relative to the metal skin.

22. A furnace as in claim 21 wherein the terminal bar mounting means includes a centering ring mounted on the metal skin extending about the terminal bar in a spaced relationship thereto and engaged with the tube about the small outer end of its opening, at least one spacer engaged with the centering ring and with the outer end of the terminal bar to provide positioning thereof, a mounting ring extending about the outer end of the terminal bar and engaged with the spacer, and spring means for biasing the mounting ring against the spacer to compress the spacer between the mounting and centering rings and to compress the centering ring against the passage tube as well as compressing the passage tube against the heating chamber.

23. A furnace as in claim 22 wherein there are at least two spacers positioned on opposite sides of the terminal bar outer end, each spacer being made of fused silica, the centering ring being of graphite and having recesses that receive and position the spacers, and the mounting ring being metallic and having recesses for receiving and positioning the spacers.

24. A furnace as in claim 23 wherein the terminal includes a water cooled metallic mount that locates the centering ring and also locates the passage tube about the outer end of the opening thereof, a water cooled terminal block electrically connected to the outer end of the terminal bar in a sealed relationship, and a seal extending between the water cooled mount and the water cooled terminal block to enclose the centering and mounting rings as well as the spacers and to thereby seal the terminal.

25. A high temperature furnace comprising: an elongated housing including graphite wall panels defining an elongated heating chamber and insulation about the chamber for reducing heat flow therefrom to the environment; a plurality of electrically conductive elements received within the heating chamber; a plurality of electrical insulators positioned between the conductive elements at selected locations; the conductive elements being engaged with each other to establish an electrical flow path therethrough for heating the chamber and said insulators cooperating with the conductive elements to control the direction of the electrical flow path; first resilient means located externally of the housing; connecting means extending between the first resilient means and the conductive elements within the heating chamber to compress the conductive elements and the insulators in position while allowing expansion thereof longitudinally with respect to the housing during heating of the chamber; and second resilient means for compressing the graphite wall panels longitudinally with respect to the housing to position the panels relative to each other while allowing longitudinal expansion thereof during heating of the chamber.

26. A high temperature furnace comprising: an elongated housing including graphite wall panels defining an elongated heating chamber and insulation that reduces heat flow from the chamber to the environment; said wall panels including interlocking edges; a plurality of electrically conductive elements including graphite spacer blocks spaced laterally within the chamber along the length thereof and graphite heater bars extending laterally between the spacer blocks at spaced locations along the length of the housing; a plurality of electrical insulators positioned at selected locations between the conductive elements to cooperate therewith in establishing a serpentine electrical flow path therethrough for heating the chamber; first resilient means including a gas cylinder adjacent one end of the heating chamber; a graphite connecting rod connected to the gas cylinder of the first resilient means and extending into the chamber to compress and position the conductive elements and insulators relative to each other while allowing expansion thereof during heating of the chamber; second resilient means including extendable gas cylinders at the ends of the housing for compressing the wall panels toward the longitudinal center of the housing to maintain engagement of the interlocking edges thereof so as to position the wall panels while allowing expansion thereof during heating of the chamber; and a conveyor including graphite product carrying trays and means for pushing the trays through the heating chamber.

27. A high temperature furnace comprising: an elongated housing including graphite wall panels defining an elongated heating chamber, said wall panels including interlocking edges, carbon black powder insulation about the heating chamber for reducing heat flow therefrom to the environment, and a sheet metal skin enclosing the insulation; said wall panels including horizontal separating panels that divide the heating chamber into a conveying passage and a heating portion; a plurality of electrically conductive graphite elements received within the heating portion of the chamber; a plurality of boron nitride insulators positioned at selected locations between the graphite elements to cooperate therewith in establishing an electrical flow path therethrough for heating the chamber; first resilient means including a gas cylinder adjacent one end of the heating chamber; a graphite connecting rod connected to the gas cylinder of the first resilient means and extending into the heating portion of the chamber to compress and position the conductive elements and insulators relative to each other while allowing expansion thereof during heating of the chamber; second resilient means including gas cylinders at the ends of the housing for compressing the wall panels toward the longitudinal center of the housing so as to maintain engagement of the interlocking edges thereof in a manner that positions the wall panels while allowing expansion thereof during heating of the chamber; and a conveyor including graphite product carrying trays with leading and trailing edges that overlap each other, means for pushing the trays through the heating portion of the chamber, and scraping means for cleaning the tray edges after passage thereof through the chamber.

28. A high temperature furnace comprising: an elongated housing including graphite wall panels defining an elongated heating chamber, carbon black powder insulation about the chamber for reducing heat flow therefrom to the environment, and a sheet metal skin enclosing the insulation; said graphite wall panels having interlocking edges; certain of the graphite wall panels being horizontal separating panels that divide the heating chamber into a pair of upper and lower heating portions and a pair of upper and lower conveying passages located between the heating portions adjacent each other; a plurality of electrically conductive graphite elements received within each heating portion of the chamber; said conductive graphite elements including spacer blocks spaced laterally in the heating portions of the chamber along the length thereof and heater bars extending laterally between the spacer blocks along the lengths of the chamber heating portions; boron nitride insulators positioned at selected locations between the graphite elements to cooperate therewith in establishing a serpentine electrical flow path within the chamber heating portions for heating the conveying passages; first resilient means including a plurality of gas cylinders adjacent one end of the chamber; a plurality of graphite connecting rods connected to the gas cylinders of the first resilient means and extending into the heating portions of the chamber to compress and position the conductive graphite elements and the boron nitride insulators relative to each other while allowing expansion thereof during heating of the chamber; second resilient means including cooperable pairs of gas cylinders at the ends of the housing for compressing the wall panels toward the longitudinal center of the housing so as to maintain engagement of the interlocking edges thereof in a manner that positions the wall panels while allowing expansion thereof during heating of the chamber; a conveyor including product carrying graphite trays with leading and trailing edges that overlap each other; conveyor pushers at each end of the housing for pushing the trays through the conveying passages of the heating chamber in opposite directions in a counterflow manner; a transfer mechanism at each end of the housing; each transfer mechanism including a tray indexer having entrance and exit indexers for indexing the trays into and out of the housing in a lateral direction with respect thereto and a vertically movable table onto which the trays are indexed from the housing after passage through one conveying passage and from which the trays are indexed into the housing for conveyance through the other conveying passage; each transfer mechanism including scraper bars having elongated guide portions and scraper portions for engaging the leading and trailing edges of the trays during indexing; means for biasing one of the scraper bars toward the other scraper bar so that the cleaning portions thereof clean the tray edges during indexing; and the table having edges for engaging the scraper bars to prevent the cooperative action of the biasing means and the scraper bars from cutting material off the tray edges during cleaning.

29. A furnace as in claim 27 further including porous carbon wall panels for limiting heat flow along the length of the heating chamber.

30. A furnace as in claim 28 wherein the housing includes graphite side wall panel liners in the conveying passages of the chamber, certain of the graphite horizontal separating panels defining an intermediate wall between the upper and lower conveying passages, and said intermediate wall including openings between the upper and lower conveying passages at each end of the housing to aid in heat transfer therebetween.

31. A furnace as in claim 28 further including a plurality of electrical terminals connected to the conductive elements, each terminal including: a passage tube extending from the outer skin of the housing to the chamber and including an opening therethrough with a greater horizontal extent adjacent the chamber than adjacent the skin; a terminal bar extending through the passage tube and having an inner end connected to the conductive elements and an outer end projecting outwardly beyond the skin; and sealed means for mounting the outer end of the terminal bar on the skin.

32. A furnace as in claim 28 wherein each end of the elongated housing includes a first feeder for supplying powdered carbon black to the graphite trays entering the heating chamber adjacent thereto, and each end of the elongated housing also including a second feeder for supplying crystalline silica to the trays over the powdered carbon black.

33. A furnace as in claim 28 wherein the graphite wall panels include top wall panels having lateral edges, side wall panels with upper edges on which the lateral top wall panel edges are supported, and interlocking connections between the top wall panel lateral edges and the side wall panel upper edges that prevent outward side wall movement.

34. A furnace as in claim 33 wherein certain of the horizontal separating panels provide horizontal walls between the chamber heating portions and conveying passages and include interlocking connections with the side wall panels.

35. A furnace as in claim 33 further including graphite side wall liners within the conveying passages.

36. A furnace as in claim 35 wherein the side wall liners include grooves that receive the trays during conveyance thereof through the conveying passages.

* * * * *